US005690255A

United States Patent [19]

White

[11] Patent Number: 5,690,255

[45] Date of Patent: Nov. 25, 1997

[54] PORTABLE UNITARY STORAGE ORGANIZER

[76] Inventor: Horace S. White, 2101 N. Dixie Hwy., Fort Lauderdale, Fla. 33305

[21] Appl. No.: 683,903

[22] Filed: Jul. 19, 1996

Related U.S. Application Data

[63] Continuation of Ser. No. 499,956, Jul. 10, 1995, Pat. No. 5,577,639.

[51] Int. Cl.[6] ..... B67D 5/52

[52] U.S. Cl. ..... 222/135; 222/192; 312/209

[58] Field of Search ..... 222/135, 180, 222/129, 192, 321.7; 312/209, 227, 224, 245

[56] References Cited

U.S. PATENT DOCUMENTS

| | | | |
|---|---|---|---|
| 4,510,978 | 4/1985 | Arens | 222/180 X |
| 4,663,621 | 5/1987 | Field et al. | 312/209 X |
| 4,925,285 | 5/1990 | Dowdell et al. | 312/227 X |
| 5,152,430 | 10/1992 | DeTorres | 222/135 X |
| 5,577,639 | 11/1996 | White | 222/192 |

*Primary Examiner*—Gregory L. Huson
*Attorney, Agent, or Firm*—Oltman, Flynn & Kubler

[57] ABSTRACT

Integrated organizational centers including storage areas and liquid dispensing pumps are included. A first embodiment includes a storage container with rollable door that is attached to and is located in between identical liquid pump dispensing containers. The entire device is mounted on rubber pads allowing it to be portable and movable to desirable locations along side sinks in kitchens and bathrooms by rubber mounting pads and the like. The pump dispensing containers can dispense liquids such as liquid soaps and hand and moisturizing lotions. A second embodiment includes a similar arrangement of components except that the door is comprised of double exterior opening doors with mirrors on the inside portion of the walls. The second embodiment can use the same liquids in addition to shampoos and conditioners where the device itself can be permanently mounted to the interior wall of a shower by double sided tape and the like. A third embodiment is similar to the first embodiment but additionally adds a third pumpable liquid dispensing container and an exterior step ledge for supporting a reusable cup and the like. The third embodiment can further include double drawers for housing razors, rube toothpaste and the like. All the embodiments are formed from plastic type materials and can include optional ventilation holes in the sides and bottom to allow the interiors of the storage containers to air dry by exterior air.

2 Claims, 5 Drawing Sheets

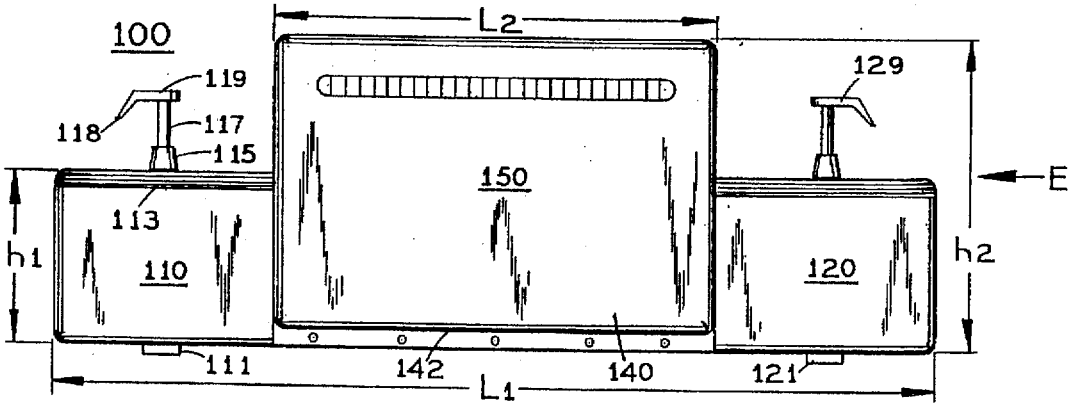
FIG. 1A
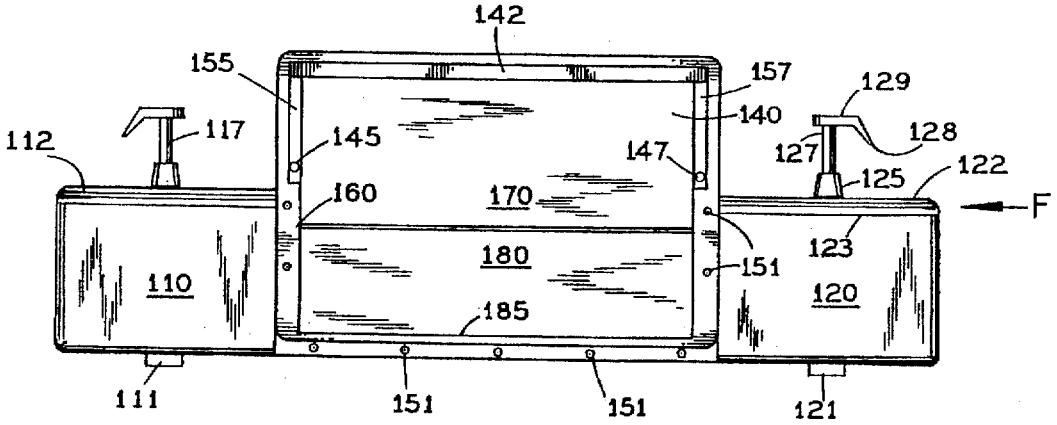
FIG. 1B
FIG. 1C
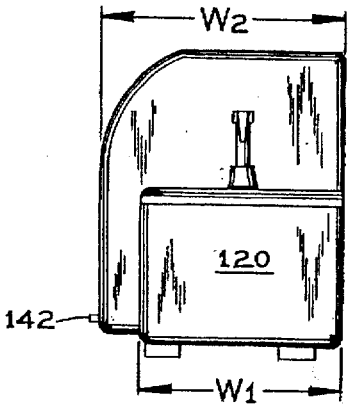
FIG. 1D
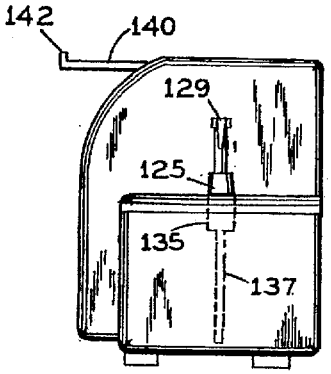

PORTABLE UNITARY STORAGE ORGANIZER

This application is a continuation of application Ser. No. 08/499,956 filed Jul. 10, 1995, now U.S. Pat. No. 5,577,639.

This invention relates to dispenser organizers, and more specifically to dispenser organizers for liquids, liquid soaps, shampoos, lotions and mouthwashes for kitchens, showers and bathrooms.

BACKGROUND AND PRIOR ART

Currently soap bars are loosely stored on countertops, sink tops and the like. The loose storage of soap bars can create soap deposit stains on the surfaces of which the soap is left. Current methods for storing and dispensing liquid soaps, shampoos and lotions are usually from the original manufacturer's packages of which the liquid materials sold in. These liquid materials can spill and cause an unsightly mess that necessitates cleaning up after the use and as well as a spill. Furthermore, keeping the materials in the various separate portable containers in which they originally are packaged can create an undesirable aesthetic appearance when these containers are left on kitchen countertops, around sinks, bathroom fixtures, around showers and the like. Likewise, other loose articles in bathrooms such as toothpaste, toothpaste brushes, shaving cream razors and the like often must be loosely stored on sinktops themselves also adding to undesirable aesthetic appearances. Furthermore, these separate loose containers can easily become misplaced and lost.

Current types of storage for personal items include bathroom cabinets. However, these cabinets are usually inadequate and do not allow for both storing and dispensing the items previously mentioned. Likewise, shower caddys which are often wire-framed supports which hang from a shower nozzle are not sized large enough for storing all types of personal items used in a shower. Furthermore, the caddys are open enclosures whose contents are constantly subjected to the water and soap spray from the shower itself. Further, the "shower caddys" do not allow for any type of liquid pump dispensing.

Thus, the need exists for a solution to the problems presented above.

SUMMARY OF THE INVENTION

The first objective of the present invention is to provide an organizational storage and dispensing apparatus for sink tops in kitchens.

The second object of this invention is to provide an organizational storage and dispensing apparatus for bathrooms.

The third object of this invention is to provide an organizational storage and dispensing apparatus for showers.

The fourth object of this invention is to provide an organizational storage and dispensing apparatus for items used for personal grooming.

Three preferred embodiments of organizational storage and dispensing devices are disclosed. A first preferred embodiment is an integrated organizational center portable device for kitchens and bathrooms that includes two liquid pump dispensing containers and a storage container with rollable door located therebetween. A second preferred embodiment is an integrated organizational center device for all shower essentials includes exterior opening double doors with mirrors on the inside walls as a central storage container, and with dual liquid pump dispensing containers on both sides. The shower embodiment can be permanently affixed to the side interior wall of a shower by double sided tape and the like. A third preferred embodiment is a personal grooming integrated center portable device for storing and dispensing of grooming, dental and hygiene products. The grooming embodiment includes all elements of the first embodiment with the addition of a third liquid pump dispenser, an outside step ledge for supporting a reusable cup and at least one exterior opening storage drawer. Liquids that can be dispensed form the dispensing containers include but are not limited to liquid soap, lotions, shampoo, conditions, mouthwash and the like. Both the first and third embodiments can be mounted on counters and toilet tops by rubber pads and the like. All the components in the embodiments can be formed from molded plastics and the like.

Further objects and advantages of this invention will be apparent from the following detailed description of a presently preferred embodiment which is illustrated schematically in the accompanying drawings.

BRIEF DESCRIPTION OF THE FIGURES

FIG. 1A is a front view of the first preferred embodiment sink device invention with a closed lid.

FIG. 1B is a front view of the invention of FIG. 1A with the lid in an open position.

FIG. 1C is a view of the invention of FIG. 1A along arrow E.

FIG. 1D is a view of the invention of FIG. 1B along arrow F.

DESCRIPTION OF THE PREFERRED EMBODIMENT

Figure 2B:
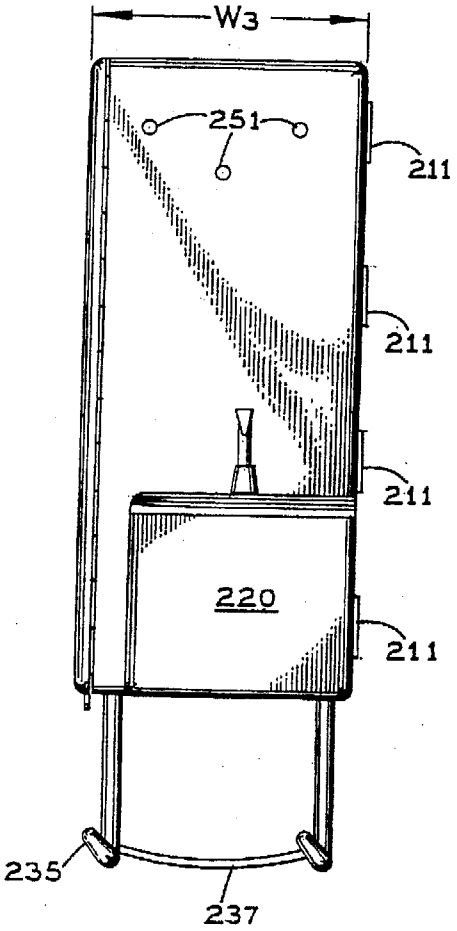
FIG. 2B is a side view of the invention of FIG. 2A along arrow G.

Before explaining the disclosed embodiment of the present invention in detail it is to be understood that the invention is not limited in its application to the derails of the particular arrangement shown since the invention is capable of other embodiments. Also, the terminology used herein is for the purpose of description and not of limitation.

FIRST EMBODIMENT

FIG. 1A is a front view of the first preferred embodiment sink device invention 100 with a closed lid 140. FIG. 1B is a front view of the invention 100 of FIG. 1A with the lid 140 in an open position. FIG. 1C is a view of the invention 100 of FIG. 1A along arrow E. FIG. 1D is a view of the invention 100 of FIG. 1B along arrow F. Referring to FIGS. 1A through 1D, sink device is an integrated organizational center for kitchen and bathroom sink tops. Sink device 100 includes left dispenser 110 and fight dispenser 120 which are sized to be filled with approximately 12 oz. of liquid soaps and lotions. Dispenser 110 has a slidable cover 112 which can snapably connect to base 110 along ridge 113. Alternatively cover 112 can slide off ridge 113. Cover 112 includes cylindrical stop member 115, movable piston member 117, conventional pump button portion 119, and nozzle end 118. Right dispenser 120 has a slidable cover 122 which can snapably connect to base 120 along ridge 123. Alternatively cover 122 can slide off ridge 123. Cover 122 includes cylindrical stop member 125, movable piston member 127, conventional pump button portion 129 and nozzle end 128. Pushing down on push buttons 119 and 129 causes liquid inside of the respective dispenser to come out through nozzle ends 118 and 128 respectively. FIG. 1D shows the interior portion of cylindrical stopper 135 with receiving straw portion 137 the latter of which draws liquid from inside dispenser 120 upward when push button 129 is depressed.

In the center area of sink device 100 is the organizational area 150 consisting of rollable lid 140 with raisable lever 142 which rolls upward by protruding members 145 and 147 into the interior housing along respective tracks 155 and 157. Component 140' refers to the interior surface of lid 140. Inside the organizational area are storage areas 170 and 180 which each contain respective storage ledges 160 and 185 that allow for the storing of toothbrushes, toothpaste, bars of soap and the like. Central storage area 150 can further include vent holes 151 in the sides and/or bottom sides. Referring to FIGS. 1A through 1D, device 100 can have a length L1 of approximately 18 inches and center area 150 can have a length L2 of approximately 10 inches.

Referring to FIGS. 1A and 1B, each dispenser 110 and 120 can have a height, h1, of approximately 3.5 inches while the height, h2, of center area 150 can be approximately 6 inches. Referring to FIGS. 1C and 1D, each dispenser 110 and 120 can have a width, W1, of approximately 4 inches, while central area 150 can have a width, W2, of approximately 5 inches. Device 100 can further include legs 111 and 121 which can be formed from molded plastic or alternatively can be rubber pads and the like. All components shown in FIGS. 1A through 1D can be formed from moldable material such as but not limited to ABS plastic, fiberglass, Jelcoat, and the like.

SECOND EMBODIMENT

Figure 2A:
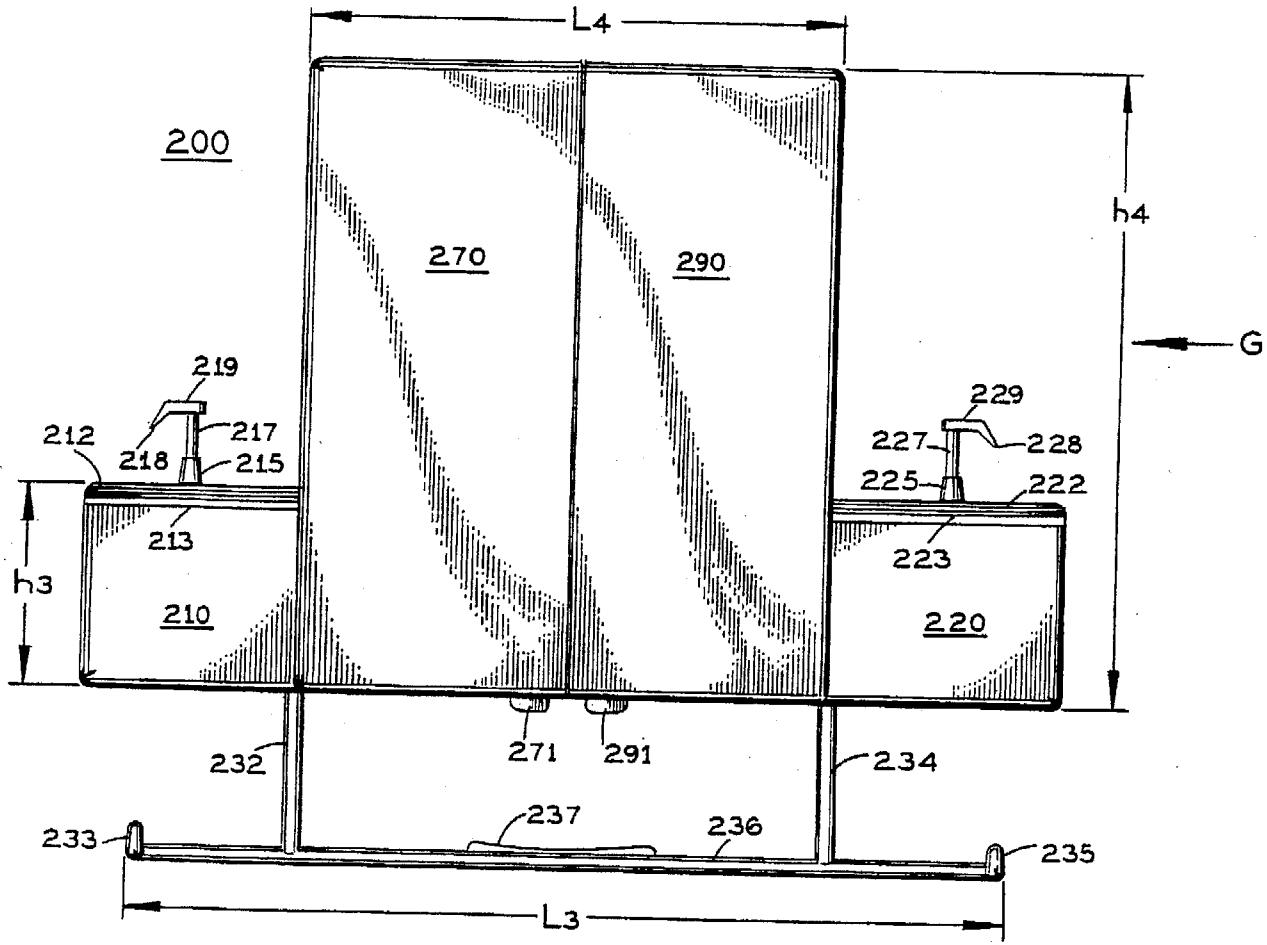
FIG. 2A is a front view of the second embodiment shower device invention with closed doors.
Figure 2D:
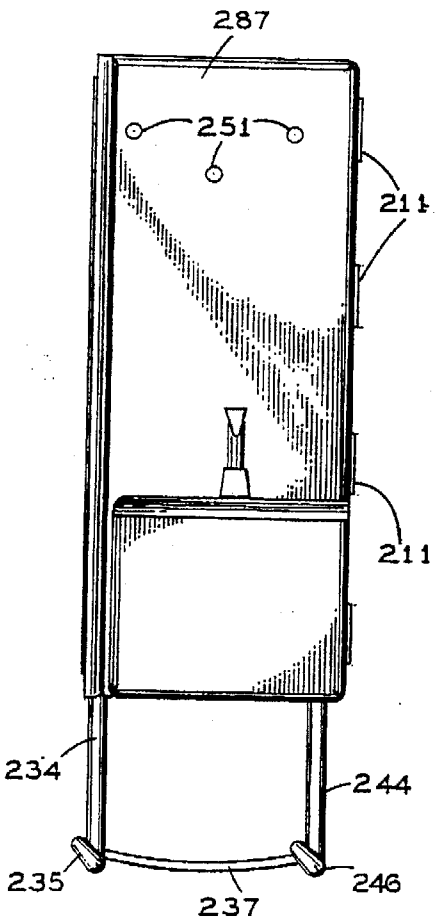
FIG. 2D is a side view of the invention of FIG. 2A along arrow G.
Figure 2C:
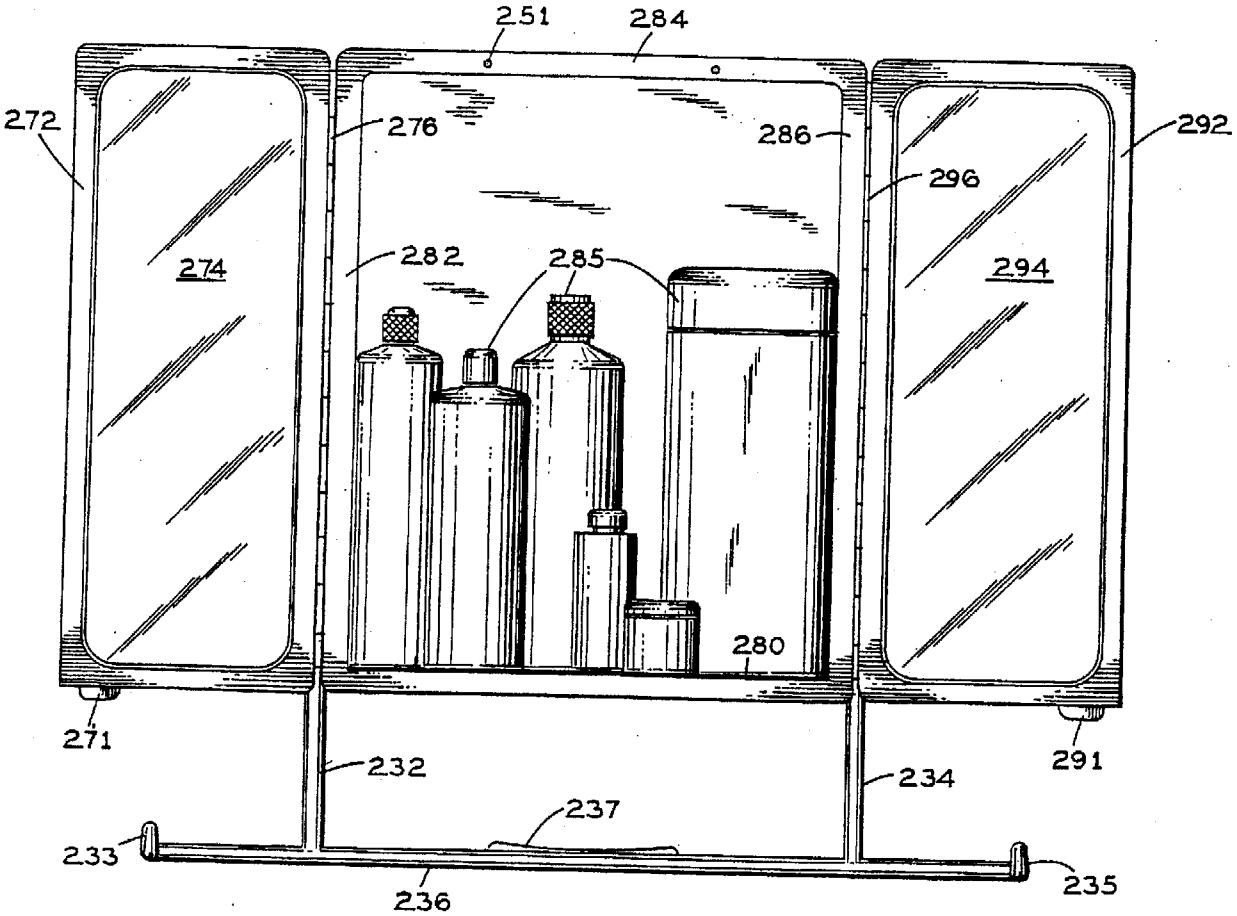
FIG. 2C is a front view of the invention of FIG. 2A with the doors in an open position.

FIG. 2A is a front view of the second preferred embodiment shower device invention 200 with closed doors 270 and 290. FIG. 2B is a side view of the invention of FIG. 2A along arrow G. FIG. 2C is a front view of the invention 200 of FIG. 2A with the doors 270 and 290 in an open position. FIG. 2D is a side view of the invention 200 of FIG. 2A along arrow G. The front of shower device 200 can have a length, L3, of approximately 18 inches from left dispenser 210 to fight dispenser 220, and storage doors 270, 290 can have a length, L4, of approximately 10 inches. Each dispenser, 210 and 220 can have a height, h3, of approximately 4 inches while the height of storage doors 270, 290 can have a height, h4, of approximately 12 inches. The width, W3, of shower doors 270, 290 can be approximately 5 inches.

Referring to FIGS. 2A through 2D, shower device 200 includes left dispenser 210 and right dispenser 220 which correspond to similar dispenser components 110 and 120 of FIGS. 1A–1D. Left dispenser 210 and right dispenser 220 which are sized to be filled with approximately 12 oz. of shampoo, conditioner, body shampoo, liquid soaps, lotions and the like. Dispenser 210 has a slidable cover 212 which can snapably connect to base 210 along ridge 213. Alternatively cover 212 can slide off ridge 213. Cover 212 includes cylindrical stop member 215 movable piston member 217 conventional pump button portion 219 and nozzle end 218. Right dispenser 220 has a slidable cover 222 which can snapably connect to base 220 along ridge 223. Alternatively cover 222 can slide off ridge 223. Cover 222 includes cylindrical stop member 225, movable piston member 227, conventional pump button portion 229 and nozzle end 228. Pushing down on push buttons 219 and 229 causes liquid inside of the respective dispenser to come out through nozzle ends 218 and 228 respectively.

Referring to FIGS. 2A and 2C, left door 270 and right door 290 close off a storage space within that includes inside ledge 280 and interior walls 282, 284 and 286. Doors 270 and 290 are mounted to side walls 282 and 286 by respective plastic molded hinges 276 and 296. The opening and closing of doors 270 and 290 can be accomplished by moving respective tabs 271 and 291 connected to their respective doors. On the interior sides 272, 292 of the doors are respective mirrors 274 and 294 mounted on the doors by glue, two sided tape and the like. Interior shelf 280 can be used to for storing away supplies 285 such as but not limited to razors, sponges, soap bars, dental floss, toothpaste and the like.

Referring to FIGS. 2A–2D, ventilation holes 251 can be put in the side walls 287 and the top wall 284 and the bottom shelf area 280. On the lower side of shelf 280 are parallel rack bars 236 and 246 which are supported below by vertical rods 232, 234, 242, 244. The ends of parallel rack bars 236 and 246 are raised molded edges 233, 235, 243, 245, which can be used to support the loop rope ends of brushes 252 and the like. In a middle area of parallel rack bars 236 and 246 can be a flat plate portion 237 extending across the bars 236 and 246, which can be used to hold soap bars (not shown). The entire shower device 200 can be mounted to the interior walls of a shower by using adhesive material such as double sided tape 211. Similar to the components of FIGS. 1A–1D, all components shown in FIGS. 2A through 2D can be formed from moldable material such as but not limited to ABS plastic, fiberglass, Jelcoat, and the like.

THIRD EMBODIMENT

Figures 3A, 3C:
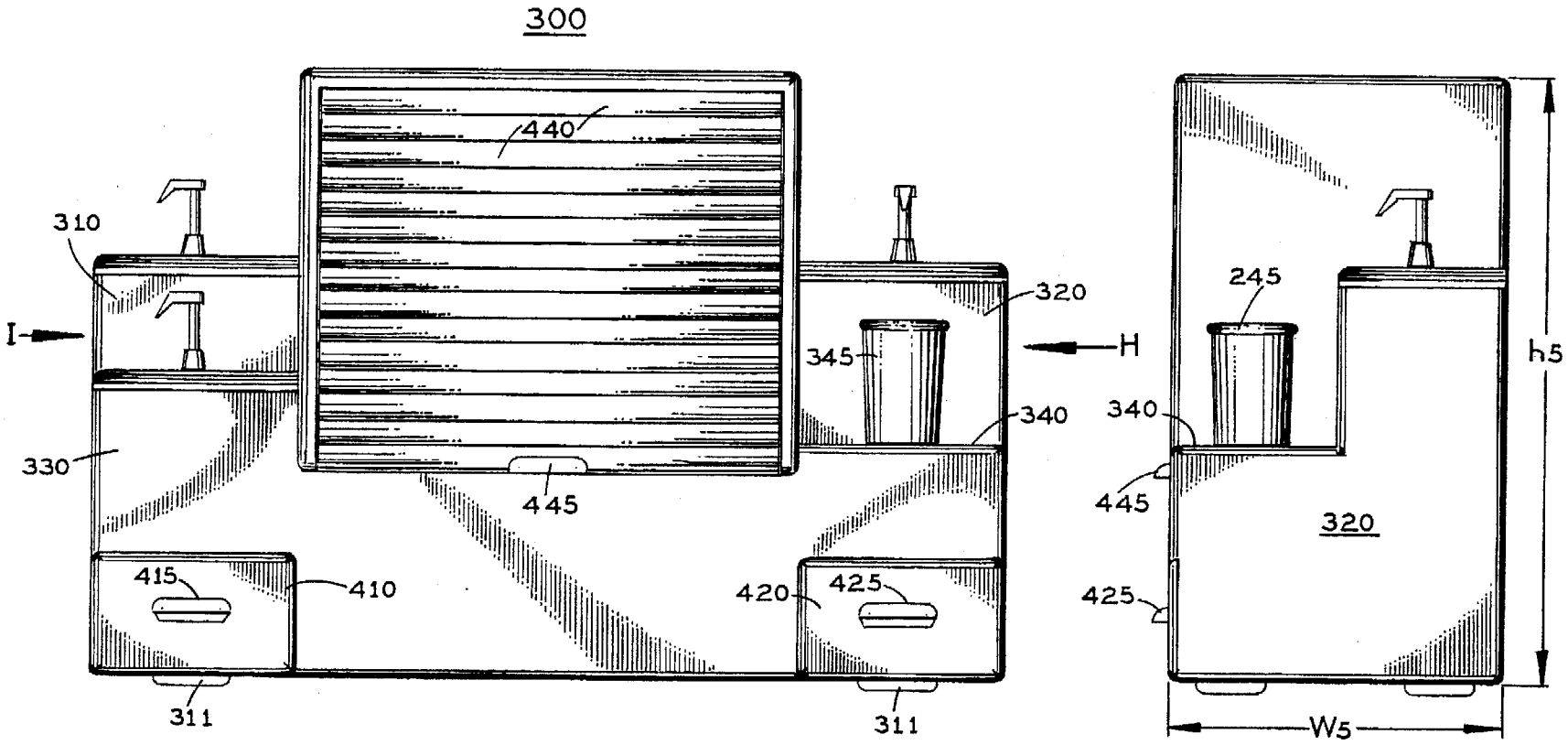
FIG. 3A is a front view of the third preferred embodiment personal grooming center invention with a closed lid.
FIG. 3C is a side view of the invention of FIG. 3A along arrow H.
Figure 3D:
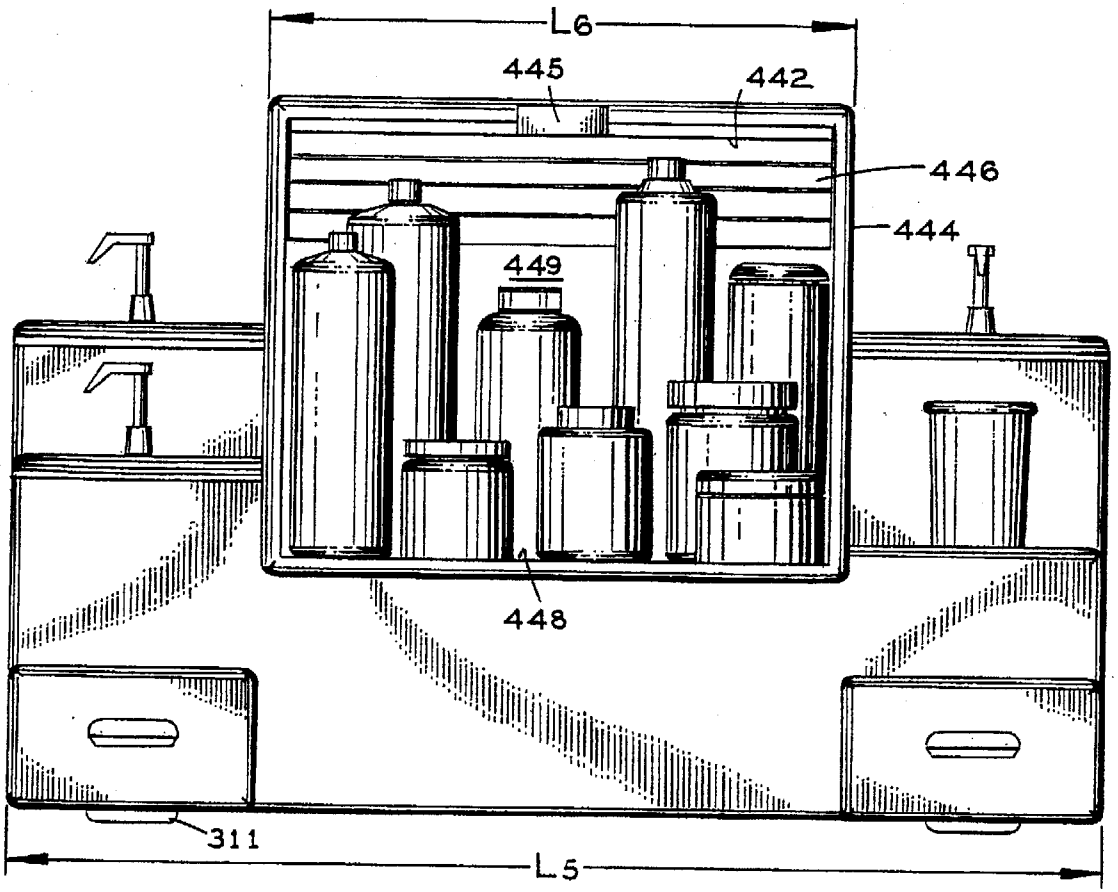
FIG. 3D is a front view of the invention of FIG. 3A with an open lid.
Figure 3B:
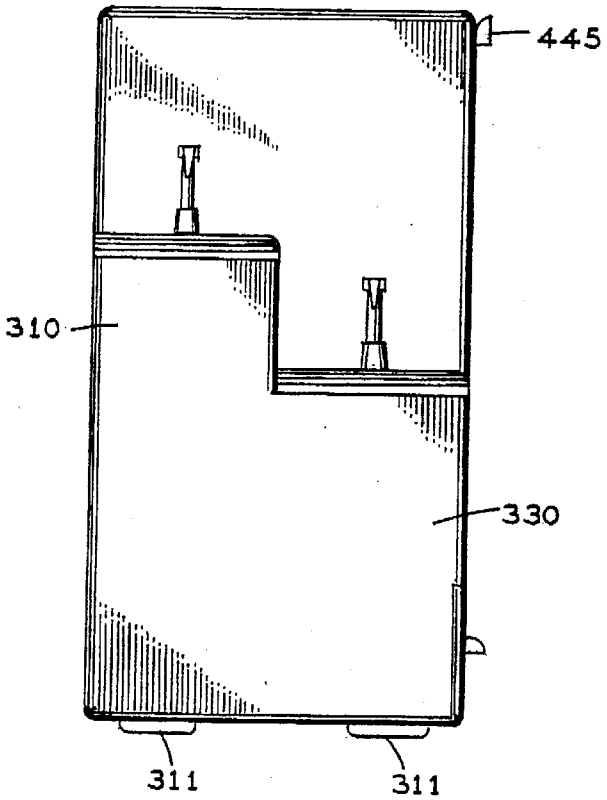
FIG. 3B is a side view of the invention of FIG. 3A along arrow I.

FIG. 3A is a front view of the third preferred embodiment personal grooming center invention 300 with a closed lid 440. FIG. 3B is a side view of the invention 300 of FIG. 3A along arrow I. FIG. 3C is a side view of the invention 300 of FIG. 3A along arrow H. FIG. 3D is a front view of the invention 300 of FIG. 3A with an open lid 442. Referring to FIGS. 4A–4D, grooming center device 300 includes three different liquid pump dispensers 310, 320 and 330 which each include components similar to like components 110, 120, 210 and 220 of FIGS. 1A and 2A. The three pump dispensers 310, 320 and 330 can be used to house liquids such as lotion, liquid soap, mouthwash, and the like. On the fight side of center 300, is a right support ledge 340 which can support a reusable plastic cup 345. Grooming device 300 can have an overall length, L5, of approximately 14 inches with central storage area 440 having a length, L6, of approximately 8 inches. Grooming center device 300 can have a width, W5, of approximately 8 inches and an overall height, h5, of approximately 10 inches.

Central storage area includes a rollable plural paned door 440 which can roll up inside housing 442. Alternatively, door 440 can be one piece and can operate similar to door 150 of FIG. 1A. Inside the storage area is a shelf ledge 448 which offers covered storage for grooming, dental and hygiene type products 449 and the like. Device 300 can further include left utility drawer 410 with left handle and right utility drawer 420 with fight handle 425. Drawers 410 and 420 can be used to store razor blades, toothpaste tubes and the like. On the bottom of grooming center 300 are mounting pads 311 which can be rubber pads, double sided tape and the like for supporting grooming center device 300. Device 300 can further include ventilation holes similar to those mentioned in reference to the preceding embodiments. Similar to the components of the preceding embodiments, all components shown in FIGS. 3A through 3D can be formed from moldable material such as but not limited to ABS plastic, fiberglass, Jelcoat, and the like.

The storage containers described in all three embodiments can be used with either single or plural parallel shelf ledges.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An integrated organizational portable storage and dispensing device for use along sinks in kitchens and bathrooms, comprising:

a first liquid pump dispensing container;

a second liquid pump dispensing container;

a storage container with two matching doors with mirrors on the inside walls connected to and aligned between the first dispensing container and the second dispensing container; and a storage rack attached to a lower side of the storage container with two upright posts.

2. The integrated organizational storage and dispensing device of claim 1, further comprising liquids used in the first and the second dispensing containers chosen from at least one of:

liquid soap and lotion.

* * * * *